US007980886B2

(12) United States Patent
Liu

(10) Patent No.: US 7,980,886 B2
(45) Date of Patent: Jul. 19, 2011

(54) SOCKET DEVICE HAVING IDENTIFICATION FUNCTION

(75) Inventor: Zhi Qi Liu, Hengyang (CN)

(73) Assignee: Lotes Co., Ltd., Keelung (TW)

( * ) Notice: Subject to any disclaimer, the term of this patent is extended or adjusted under 35 U.S.C. 154(b) by 250 days.

(21) Appl. No.: 12/212,854

(22) Filed: Sep. 18, 2008

(65) Prior Publication Data

US 2009/0269974 A1 Oct. 29, 2009

(30) Foreign Application Priority Data

Apr. 28, 2008 (CN) ..... 2008 2 0047058 U

(51) Int. Cl.
*H01R 3/00* (2006.01)

(52) U.S. Cl. ..... 439/488

(58) Field of Classification Search ..... 439/489–491, 439/86, 680, 955, 488
See application file for complete search history.

(56) References Cited

U.S. PATENT DOCUMENTS

| | | | | |
|---|---|---|---|---|
| 5,588,873 | A * | 12/1996 | Hamai et al. | 439/489 |
| 5,785,559 | A * | 7/1998 | Meyer et al. | 439/680 |
| 7,128,470 | B2 * | 10/2006 | Scherer et al. | 385/59 |
| 7,270,565 | B2 * | 9/2007 | Kamata et al. | 439/491 |
| 7,534,108 | B1 * | 5/2009 | Wang | 439/35 |
| 2003/0001715 | A1 * | 1/2003 | Montague | 337/198 |
| 2003/0032315 | A1 * | 2/2003 | Narui | 439/86 |
| 2008/0259610 | A1 * | 10/2008 | Lin | 362/311 |

FOREIGN PATENT DOCUMENTS

CN 99211097.1 8/2008

* cited by examiner

*Primary Examiner* — Edwin A. Leon
(74) *Attorney, Agent, or Firm* — Rosenberg, Klein & Lee

(57) ABSTRACT

The invention provides a conducting device having identification function, which includes a device body, a socket part disposed on the device body, a first identification unit and a second identification unit disposed on the device body. Compared with the prior art, the conducting device having identification function of the invention has the first identification unit and the second identification unit. Therefore, it could notice a user that the connecting part provides at least two connecting components having different functions for being identified to be selectively engaged so that the engagement could be more convenient and exacter.

58 Claims, 17 Drawing Sheets

SOCKET DEVICE HAVING IDENTIFICATION FUNCTION

CROSS-REFERENCE TO RELATED APPLICATIONS

This non-provisional application claims priority under 35 U.S.C. §119(a) on Patent Application No. 200820047058.1 filed in China on Apr. 28, 2008, the entire contents of which are hereby incorporated by reference.

BACKGROUND OF THE INVENTION

1. Field of the Invention

This present invention relates to a conducting device having identification function.

2. Description of the Prior Art

As information technology developing the function of a computer continuously improves, there are more and more peripheral equipments, and there are also more and more connection ports on a corresponding host. However, the equipment is also confronted with the problem of updating or substitution, and corresponding connection ports have to be made to achieve mainstream development. A part of the original connection ports should be reserved under the consideration of compatibility issue, and besides, the volume of the computer is developing towards miniaturization. Conflict therefore arises. For the present, the industry takes a way of combining similar connection ports to overcome this issue.

For example, China patent whose number is CN 99211097.1 discloses a combination terminal connector (referring to the specification and FIGS. 3-5 therewith of the patent), which consists of a socket body 10, a base 20, a top cover 30, and an outer casing 40. Its basic structure is similar to a current terminal connector. The characteristic is: socket body 10 consists of front socket body 11 and rear socket body 12, and the front and the rear socket bodies are formed by injecting plastics which have different colors to make PS/2 terminal connectors (111), (121) on the front and the rear socket bodies show different colors, so that the PS/2 terminal connectors (111), (121) could be capable of identification cable terminals of different apparatus (such as mouse and keyboard) and connecting thereto.

At present, as computer technology continuously developing, the original PS/2 terminal connectors are replaced by USB connection ports which have faster transmitting rate. However, it is unavoidable that some mice or keyboards still use PS/2 terminal connectors, and therefore, while USB connection ports are added on computer hosts under mainstream developing, PS/2 terminal connectors still need to be reserved. It unavoidably adds the procedure and the cost of design and manufacturing, and it also goes opposite to the development trend of computer miniaturization. Therefore, the manufacturer only reserves one PS/2 terminal connector capable of being plugged in by either a keyboard or a mouse. It overcomes the problem of a pair of connection ports respectively connecting different electrical components, reduces the installation of connection ports, and is conducive to the volume miniaturization of an electrical product, but a user could not know directly that the connection port is used for either connecting a keyboard or connecting a mouse, even for the both. It takes time for the user to study this. It slows the connection action down and brings inconvenience and confusion to the user.

Therefore, it is necessary to provide a new conducting device which has identification function to solve the above problems.

SUMMARY OF THE INVENTION

A scope of the invention is to provide a conducting device which is shared for at least two connecting parts capable of being identifiably engaged thereto.

A conducting device having identification function of the invention includes a device body, a socket part disposed on the device body, a first identification unit disposed on the device body, and a second identification unit disposed on the device body.

Compared with the prior art, the conducting device having identification function of the invention has the first identification unit and the second identification unit disposed on the device body, and therefore, a user could be aware that the socket part provides at least two connecting components having different functions for being identified to be selectively engaged so that the engagement could be more convenient and exacter.

The socket having identification function of the invention includes a socket body including a first semi-body and a second semi-body engaged to the first semi-body, a connecting part disposed on the socket body, a first identification unit disposed on the first semi-body, and a second identification unit disposed on the second semi-body.

Compared with the prior art, the socket having identification function of the invention has the first semi-body with the first identification unit disposed thereon and the second semi-body with the second identification unit disposed thereon, and therefore, a user could be aware that the connecting part provides at least two connecting components having different functions for being identified to be selectively engaged so that the engagement could be more convenient and exacter.

The connecting device having identification function of the invention includes a socket body including a connecting part which includes at least a first portion and a second portion corresponding to the first portion, a first identification unit disposed on the first portion, and a second identification unit disposed on the second portion.

Compared with the prior art, the connecting having identification function of the invention has the first portion with the first identification unit disposed thereon and the second portion with the second identification unit disposed thereon, and therefore, a user could be aware that the connecting part provides at least two connecting components having different functions for being identified to be selectively engaged so that the engagement could be more convenient and exacter.

The advantage and spirit of the invention may be understood by the following recitations together with the appended drawings.

BRIEF DESCRIPTION OF THE APPENDED DRAWINGS

DETAILED DESCRIPTION OF THE INVENTION

The conducting device having identification function of the invention will be further described together with the following drawings and embodiments.

Figure 1:
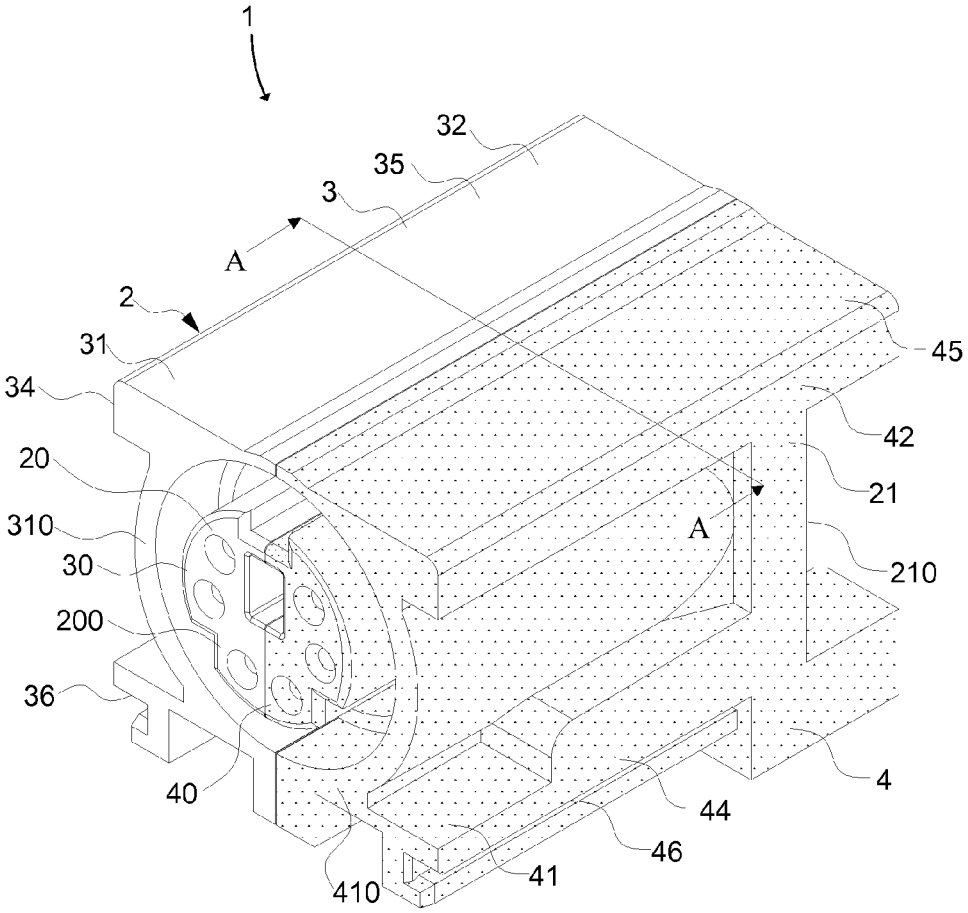
FIG. 1 is a perspective view of a conducting device having identification function of the invention.

Please refer to FIG. 1. A conducting device 1 having identification function of the invention for electrically connecting an electrical component (not shown) onto a circuit board (not shown) includes a first socket body 2 and a plurality of conducting terminals (not shown) accommodated in the first socket body 2 at least.

Figure 2:
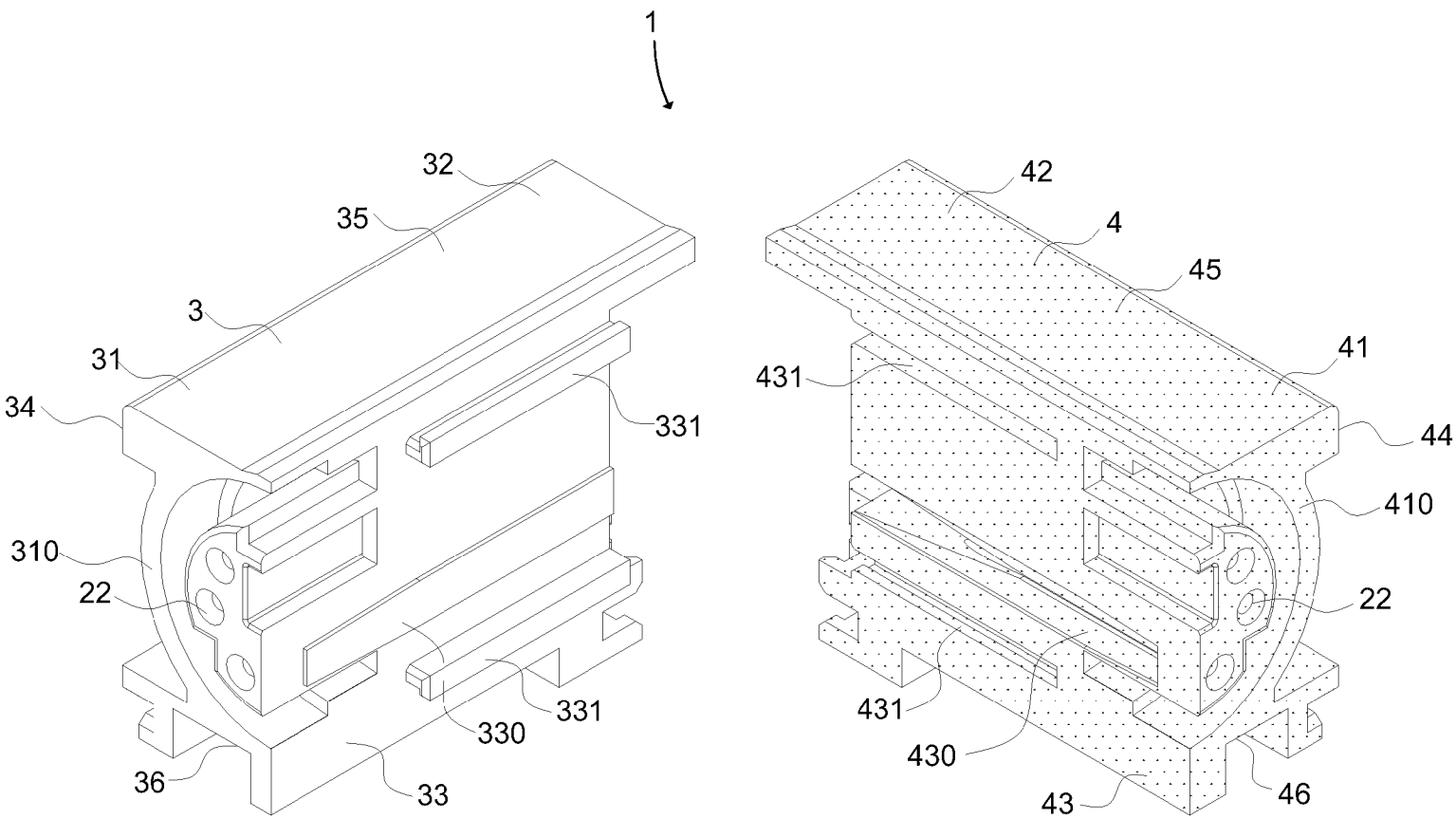
FIG. 2 is an exploded perspective view of the conducting device having identification function in FIG. 1.
Figure 3:
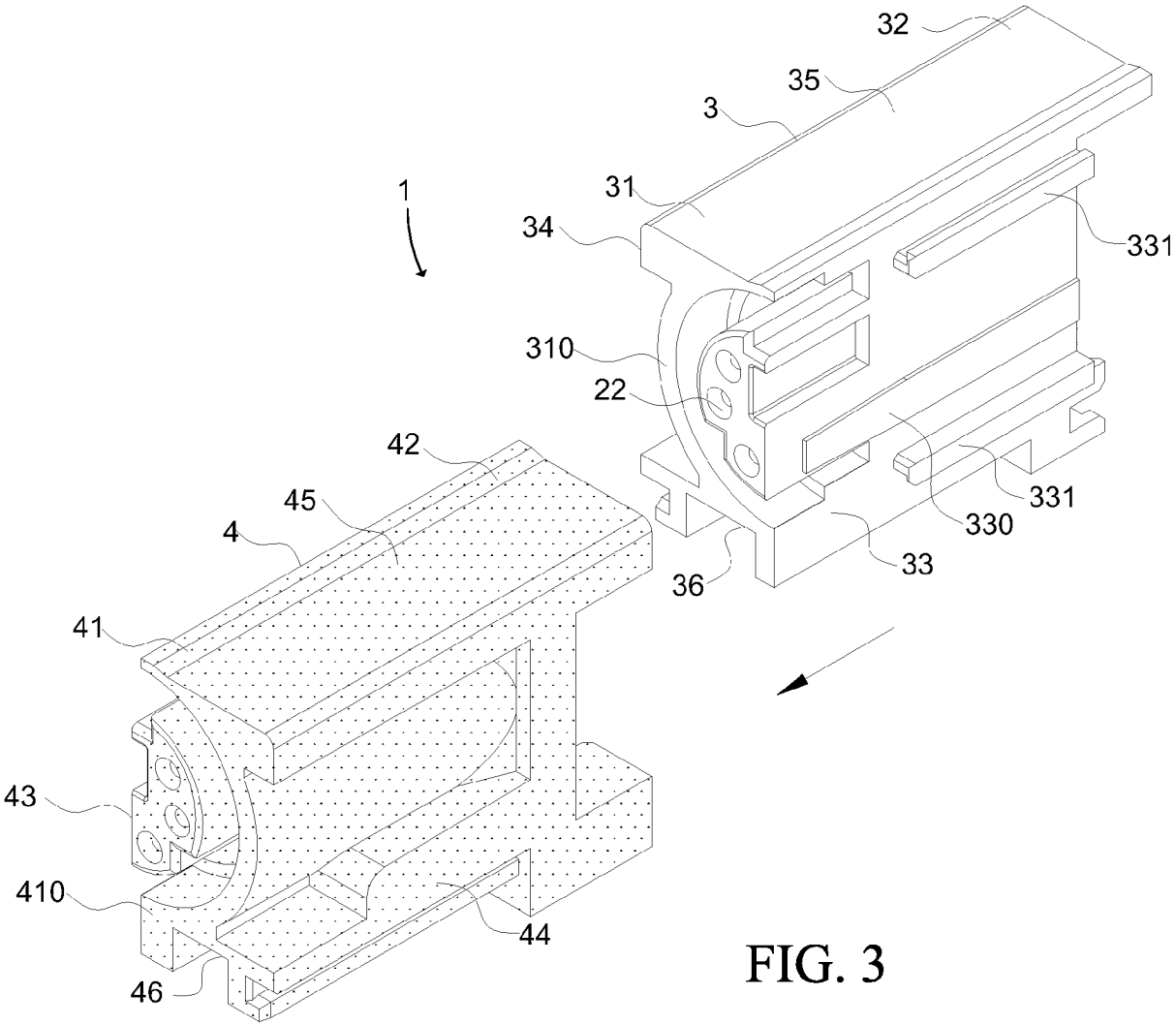
FIG. 3 is an assembly perspective view of the conducting device having identification function in FIG. 1.

Please refer to FIG. 2 and FIG. 3. The first socket body 2 is formed by a first semi-body 3 and a second semi-body 4. The first semi-body 3 and the second semi-body 4 are respectively formed by injecting plastics with different colors (such as purple and green). A first identification unit 30 is disposed on the first semi-body 3, and a second identification unit 40 is disposed on the second semi-body 4.

Please refer to FIG. 2 and FIG. 3. The first semi-body 3 has a first front portion 31 and a first rear portion 32 away from the first front portion 31. The first front portion 31 forms a first connecting surface 310. The first semi-body 3 has a first inner surface 33, a first outer side surface 34, a first top surface 35, and a first bottom surface 36, which are vertical to the first connecting surface 310. The first inner side surface 33 of the first semi-body 3 protrusively forms an engagement part 330 extending horizontally between the first front portion 31 and the first rear portion 32. The first inner side surface 33 of the first semi-body 3 forms a clasp part 331 extending horizontally between the first front portion 31 and the first rear portion 32 respectively at two sides of the engagement part 330. Moreover, the first semi-body 3 forms a plurality of first terminal-accommodating holes 22 thereon passing through the first front portion 31 and the first rear portion 32.

Please refer to FIG. 2 and FIG. 3. The second semi-body 4 has a second front portion 41 and a second rear portion 42 away from the second front portion 41. The second front portion 41 forms a second connecting surface 410. The second semi-body 4 has a second inner surface 43, a second outer side surface 44, a second top surface 45, and a second bottom surface 46. The second inner side surface 43 of the second semi-body 4 depressedly forms an engagement groove 430 extending horizontally between the second front portion 41 and the second rear portion 42. The second inner side surface 43 of the second semi-body 4 forms a clasp groove 431 extending horizontally between the second front portion 41 and the second rear portion 42 respectively at two sides of the engagement groove 430. The second semi-body 4 also forms a plurality of first terminal-accommodating holes 22 thereon passing through the second front portion 41 and the second rear portion 42.

The conducting device 1 having identification function of the invention further includes a shielding casing (not shown) which has a first opening (not shown). The shielding casing could protect the first socket body 2 and first terminals (not shown) inserted in the first socket body 2 effectively and could be grounded for electromagnetic shielding.

Figure 4:
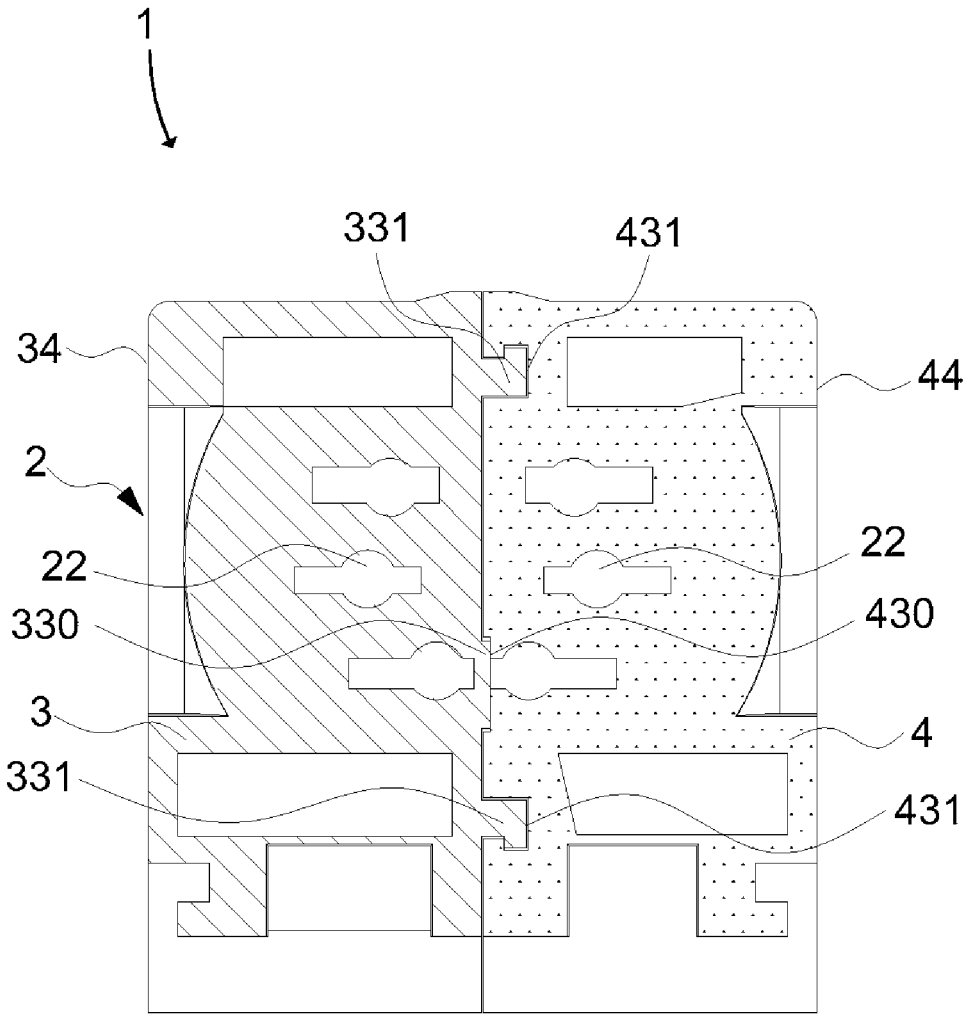
FIG. 4 is a cross section along A-A direction for the conducting device having identification function in FIG. 1.

Please refer to FIGS. 1, 3 and 4. In the assembly, first the first semi-body 3 and the second semi-body 4 with different colors respectively are assembled together. In the embodiment, the portion near the first front portion 31 of the inner side surface 33 of the first semi-body 3 formed by injecting purple plastics correspondingly contacts the portion near the second rear portion 42 of the inner surface 43 of the second semi-body 4 formed by injecting green plastics; a end of the engagement part 330 near the first front portion 31 is engaged to a end of the engagement groove 430 near the second rear portion 42; the first semi-body 3 is push along the inner surface 43 of the semi-body 4 towards the second front portion 41 of the second semi-body 4 until the engagement part 330 is engaged to the engagement groove 430 completely; the two clasp part 331 of the first semi-body 3 are correspondingly engaged to the two clasp grooves 431 of the second semi-body 4 respectively. Therefore, the first connecting surface 310 and the second connecting surface 410 are coplanar to form a connecting surface 200, and the first front portion 31 and the second front portion 41 are engaged to form a whole first socket part 20 (connecting part). Moreover, the end surface of the first rear portion 32 and the end surface of the second rear portion 42 are also coplanar and form an assembly surface 210; that is, the first rear portion 32 and the second rear portion 42 form a whole assembly portion 21. The socket body 2 is therefore assembled completely. Then, the conducting terminals are correspondingly inserted into the terminal-accommodating holes 22 of the first socket body 2. At last, the shielding casing is disposed to cover the outer surface of the first socket body 2, and the first opening corresponds to the first socket part 20. The assembly of the conducting device 1 having identification function is therefore completed.

Please refer to FIG. 1-3. For the conducting device 1 having identification function of the invention because the first socket body 2 is formed with the first semi-body 3 and the second semi-body 4, and the first semi-body 3 and the second semi-body 4 are formed by injecting different color plastics (such as purple and green), the first semi-body 3 is therefore the first identification unit 30, the first identification unit 30 is a color identification unit, and the color of the first identification unit 30 is the same as the color of the first semi-body 3. The second semi-body 4 is the second identification unit 40. The second identification unit 40 is also a color identification unit. The color of the second identification unit 40 is the same as the color of the second semi-body 4. That is, the first identification unit 30 corresponds to a keyboard and the color thereof is purple; the second identification unit 40 corresponds to a mouse and the color thereof is green. Because conducting devices for respectively connecting a keyboard and a mouse in the current industry are similar, the conducting device for connecting the keyboard is marked with purple, and the conducting device for connecting the mouse is marked with green, that the original conducting device is marked with purple and green simultaneously notices a user that the conducting device 1 having identification function could be used for connecting the keyboard and also for connecting the mouse. Certainly, the first semi-body 3 could be formed by injecting to be a green socket body, and the second semi-body 4 could be formed by injecting to be a purple socket body; that is, the color of the first identification unit 30 corresponding to the mouse is green, and the color of the second identification unit 40 corresponding to the keyboard is purple. It could also achieve the effect that the conducting device 1 having identification function could be used for connecting the keyboard and also for connecting the mouse.

Because it is difficult to inject plastics in a mold to form a component having portions with different colors, the first socket body 2 is formed with the first semi-body 3 and the second semi-body 4 at least. The first semi-body 3 and the second semi-body 4 could be formed by injecting different color plastics so that the conducting device 1 having identification function has two identification units 30, 40 with different colors for connecting components with different functions being identifiably selectively engaged thereto so as to make the engagement more convenient and exacter.

Figure 5:
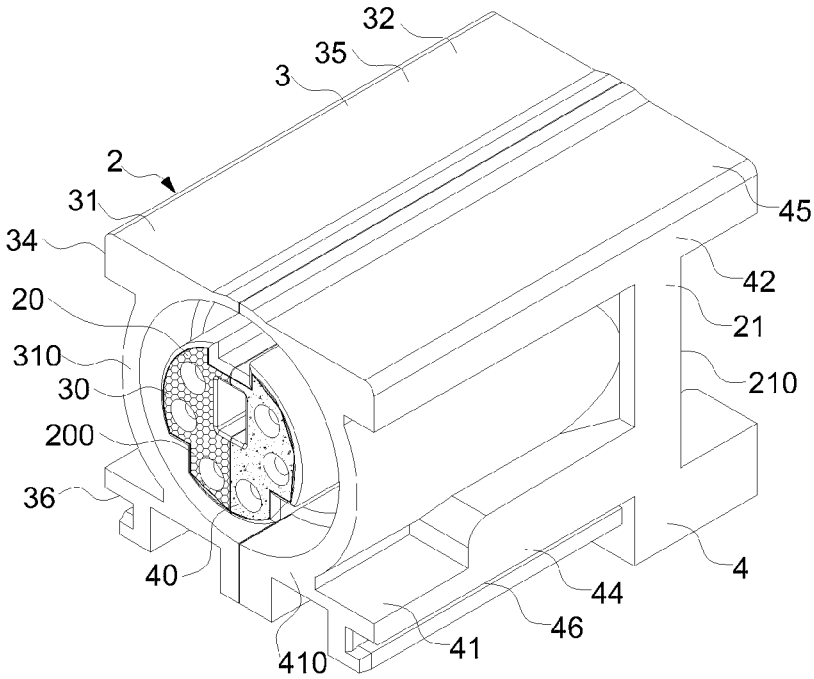
FIG. 5 is a perspective view of a conducting device having identification function of the invention according to the second embodiment.

Please refer to FIG. 5. It is the second embodiment according to the invention. What is different to the first embodiment is that: the semi-body 3 and the semi-body 4 of the conducting device 1 having identification function are formed by injecting plastics with the same color, the first identification unit 30 is a colored paster pasted on the first semi-body 3, the surface of the colored paster has a colored area such as purple; the second identification unit 40 is another colored paster pasted on the second semi-body 4, the surface of the another colored paster has a colored area such as green. It could notice a user that the connecting part provides at least two connecting components having different functions for being identified to be selectively engaged so that the engagement could be more convenient and exacter. It is no more described here.

Figure 6:
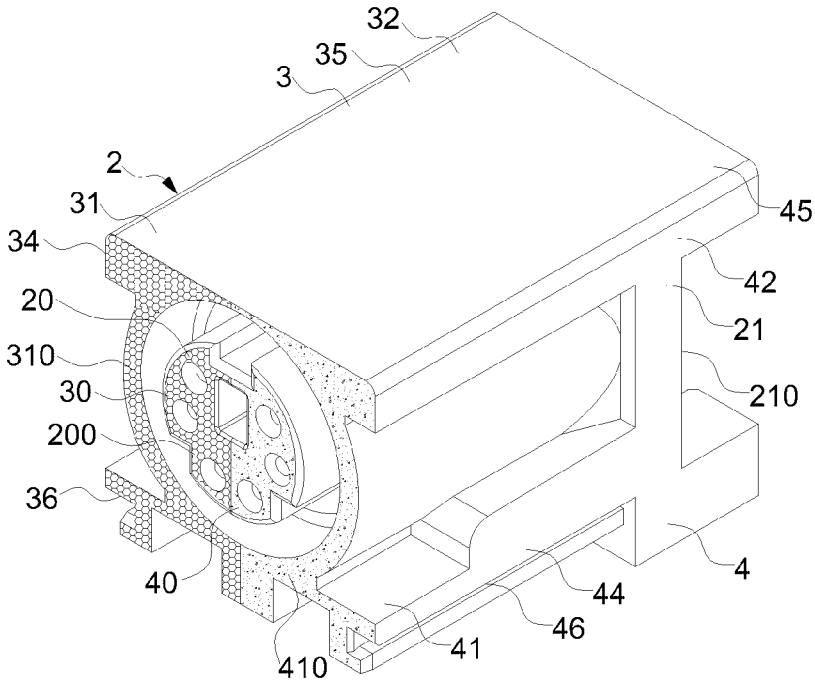
FIG. 6 is another perspective view of the conducting device having identification function of the invention according to the second embodiment.

Currently, the first socket body 2 could also be a one-piece structure. The first identification unit is the colored paster pasted on the first socket body 2, the surface of the colored paster has the colored area; the second identification unit is the another colored paster pasted on the first socket body 2, the surface of the another colored paster has the colored area such as a purple area (referring to FIG. 6). It also notices a user that the connecting part provides at least two connecting components having different functions for being identified to be selectively engaged so that the engagement could be more convenient and exacter. It is no more described here.

Figure 7:
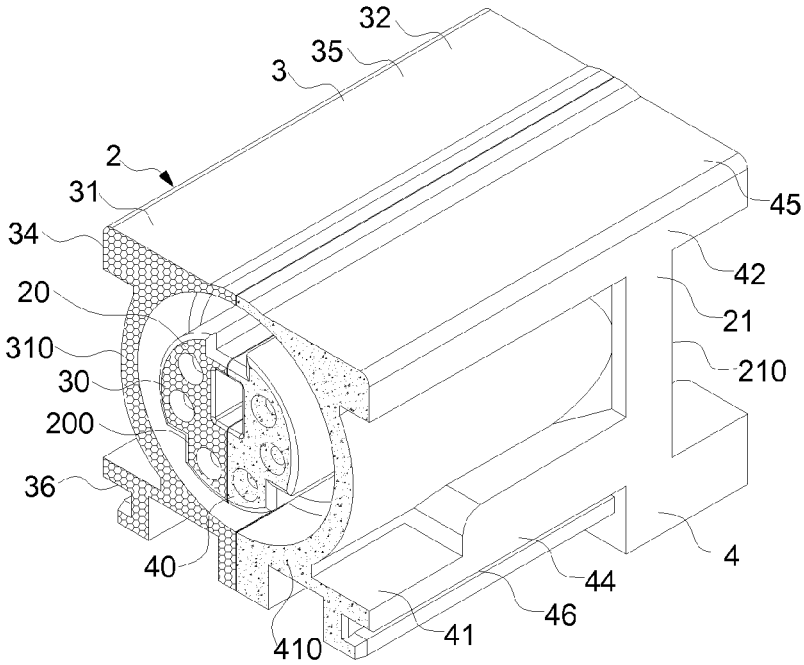
FIG. 7 is a perspective view of a conducting device having identification function of the invention according to the third embodiment.

Please refer to FIG. 7. It is the third embodiment according to the invention. What is different to the first embodiment is that: the semi-body 3 and the semi-body 4 of the conducting device 1 having identification function are formed by injecting plastics with the same color, the first identification unit 30 forms a colored area by painting a color paint on the first semi-body 3 such as a purple area, of course, the colored area could form a keyboard pattern; the second identification unit 40 forms another colored area by painting another color paint on the second semi-body 4 such as a green area, of course, the colored area could form a mouse pattern. It could notice a user that the connecting part provides at least two connecting components having different functions for being identified to be selectively engaged so that the engagement could be more convenient and exacter. It is no more described here.

Figure 8:
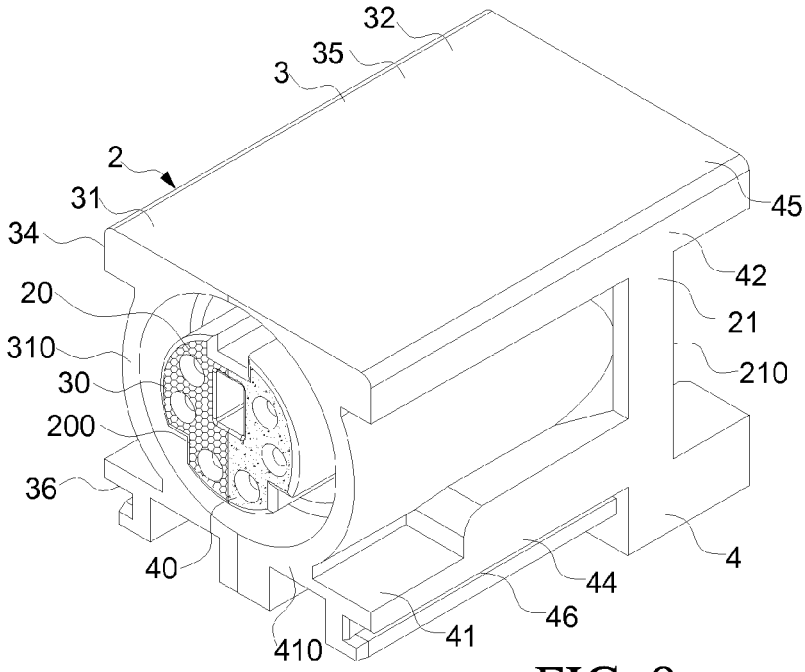
FIG. 8 is another perspective view of the conducting device having identification function of the invention according to the third embodiment.

Currently, the first socket body 2 could also be a one-piece structure. The first identification unit forms the colored area by painting the color paint on the first socket body 2; the second identification unit forms the another colored area by painting the another color paint on the first socket body 2, the surface of the another colored paster has the colored area such as a green area (referring to FIG. 8). It also notices a user that the connecting part provides at least two connecting components having different functions for being identified to be selectively engaged so that the engagement could be more convenient and exacter. It is no more described here.

Furthermore, the first socket body 2 could be formed with the first semi-body 3 and the second semi-body 4 formed by injecting the same color plastics. The first semi-body 3 and the second semi-body 4 could be formed by injecting respectively or by injecting into one piece simultaneously. The first socket body 2 is covered by a shielding casing. The first identification unit is a colored paster pasted on the shielding casing, and the surface of the colored paster has a colored area. And the second identification unit is another colored paster pasted on the shielding casing, and the surface of the another colored paster has another colored area. Of course, the first identification unit 30 could also form a colored area, such as a purple area, by painting a color paint on the shielding casing. The second identification unit 40 could also form another colored area, such as a green area (not shown), by painting another color paint on the shielding casing. It also notices a user that the connecting part provides at least two connecting components having different functions for being identified to be selectively engaged so that the engagement could be more convenient and exacter. It is no more described here.

Figure 9:
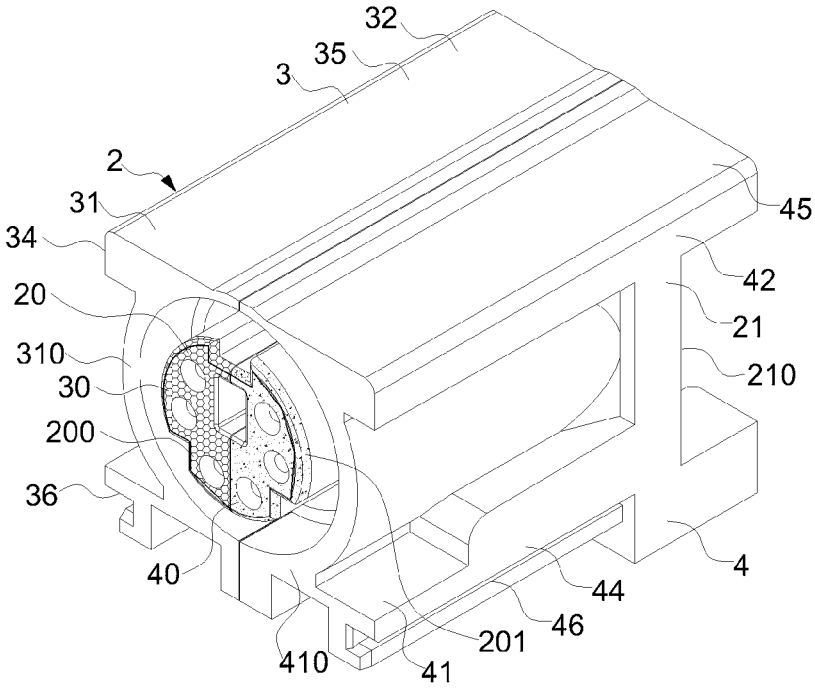
FIG. 9 is a perspective view of a conducting device having identification function of the invention according to the fourth embodiment.

Please refer to FIG. 9. It is the fourth embodiment according to the invention. What is different to the first embodiment is that: the first semi-body 3 and the second semi-body 4 of the conducting device 1 having identification function are formed by injecting plastics with the same color, a cap 201 having at least two colored blocks on a surface thereof is disposed on the front portion of the connecting part 20, one of the colored blocks is the first identification unit 30, the color of the first identification unit 30 corresponding to a keyboard is purple, another of the colored blocks is the second identification unit 40, the color of the second identification unit 40 corresponding to a mouse is green. It could notice a user that the connecting part provides at least two connecting components having different functions for being identified to be selectively engaged so that the engagement could be more convenient and exacter. It is no more described here.

Figure 10:
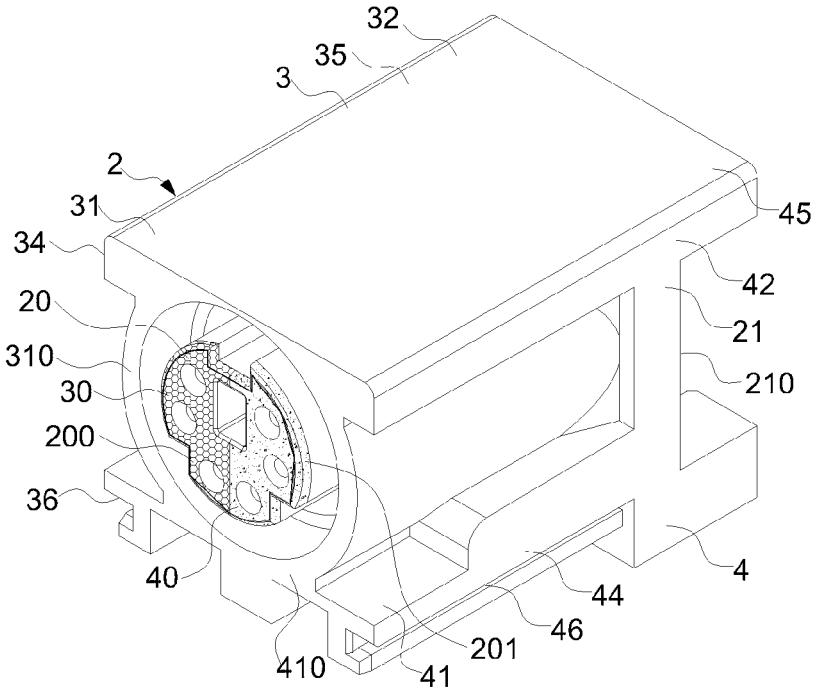
FIG. 10 is another perspective view of the conducting device having identification function of the invention according to the fourth embodiment.

Currently, the first socket body 2 could also be a one-piece structure. The cap 201 having the at least two colored blocks on the surface thereof (Please referring to FIG. 10) is disposed on the front portion of the connecting part 20. It could also achieve forementioned effect. It is no more described here.

Figure 11:
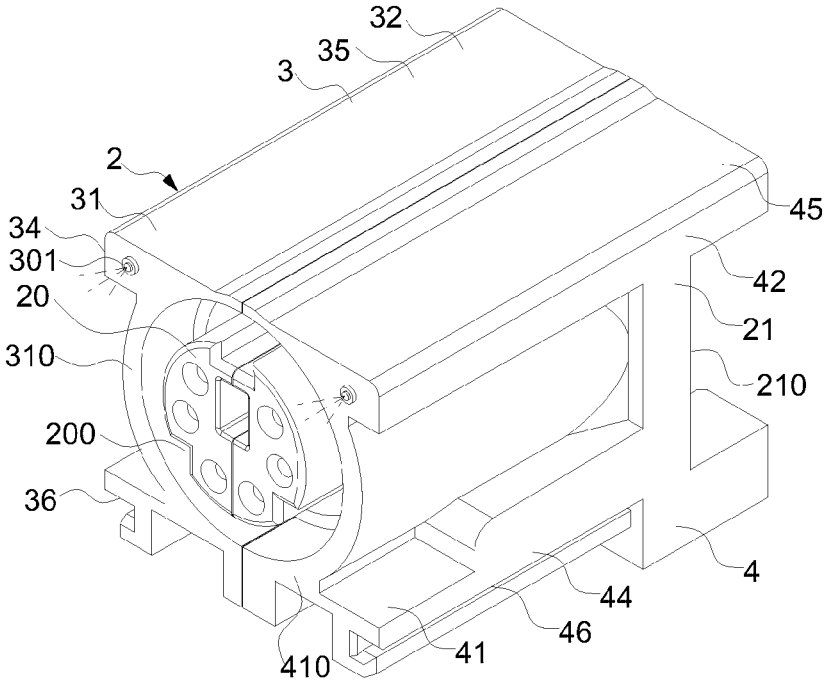
FIG. 11 is a perspective view of a conducting device having identification function of the invention according to the fifth embodiment.

Please refer to FIG. 11. It is the fifth embodiment according to the invention. What is different to the first embodiment is that: the first identification unit 30 and the second identification unit 40 of the conducting device 1 having identification function of the invention respectively have at least one light 301 emitting light in different colors. The lights are a LED lamp respectively.

Figure 12:
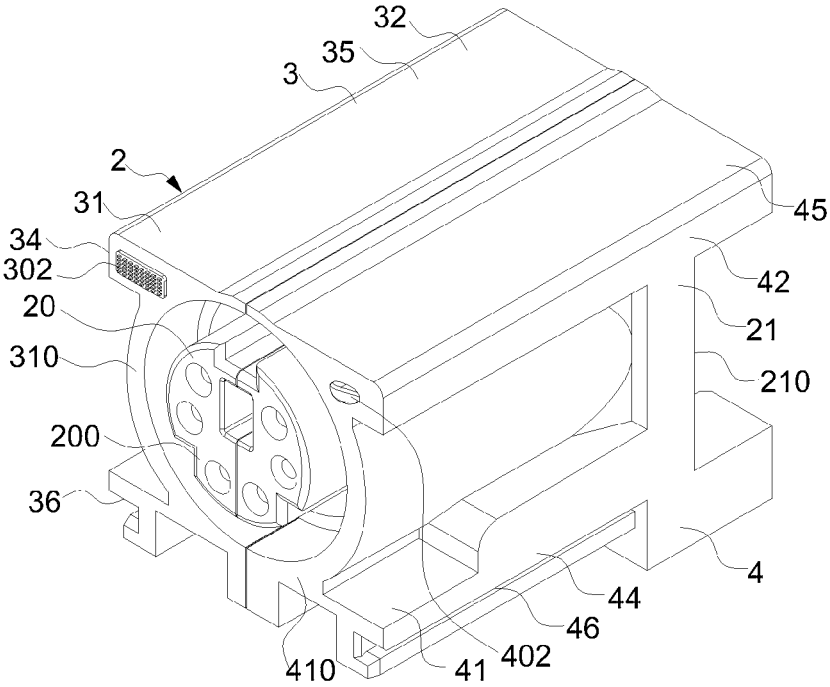
FIG. 12 is a perspective view of a conducting device having identification function of the invention according to the sixth embodiment.
Figure 13:
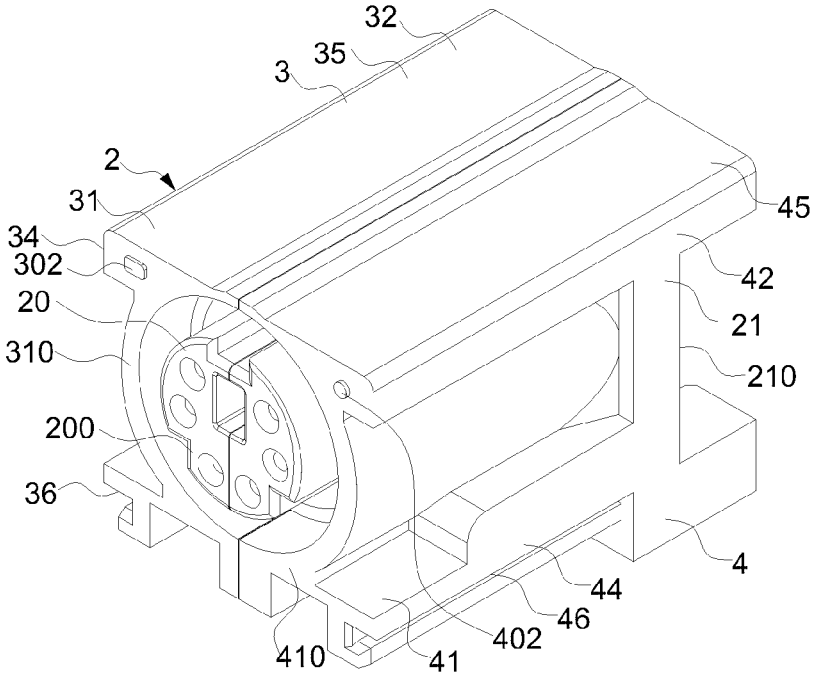
FIG. 13 is another perspective view of the conducting device having identification function of the invention according to the sixth embodiment.

Please refer to FIG. 12 and FIG. 13. It is the sixth embodiment according to the invention. What is different to the first embodiment is that: for the conducting device 1 having identification function of the invention, the first identification unit 30 has a contact part 302 at least on the surface of the first semi-body 3, the second identification unit 40 has a contact part 402 at least on the surface of the second semi-body 4, the two contact parts 302, 402 have different modeling to each other (i.e., the contact part could be a groove, a protrusive block, or a perspective pattern). In this embodiment, the first identification unit 30 is a keyboard perspective pattern, and the second identification unit 40 is a mouse perspective pattern. Of course, the first identification unit 30 could have a plurality of the contact parts 302 on the surface of the first semi-body 3 to be arranged into a Braille pattern, and the second identification unit 40 could have a plurality of the contact parts 402 on the surface of the second semi-body 4 to be arranged into another Braille pattern (not shown). Therefore, it offers a user to get identification information by contacting and makes the engagement more convenient and exacter. It is no more described here.

Figure 14:
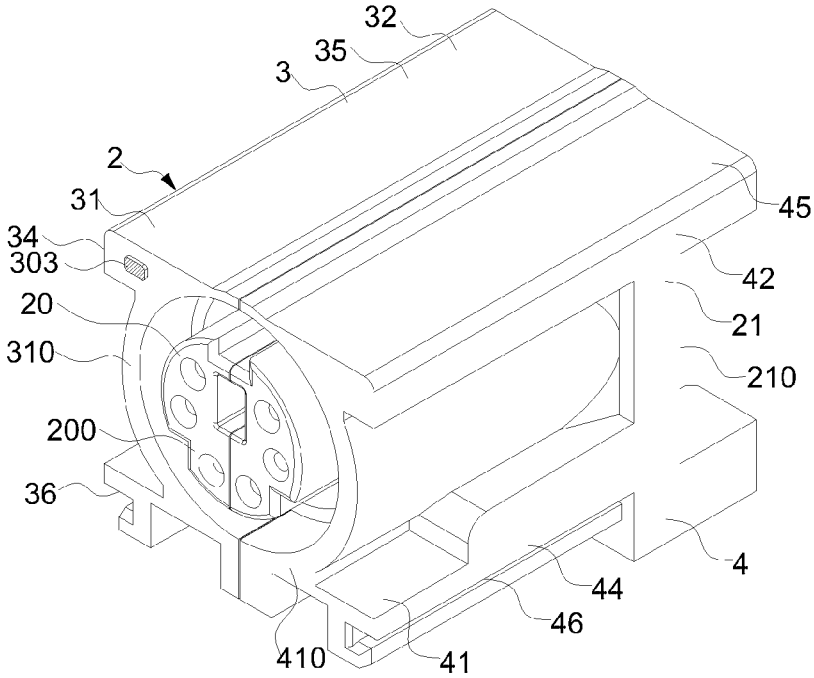
FIG. 14 is a perspective view of a conducting device having identification function of the invention according to the seventh embodiment.

Please refer to FIG. 14. It is the seventh embodiment according to the invention. What is different to the first embodiment is that: the first identification unit 30 and the second identification unit 40 of the conducting device 1 having identification function respectively have at least one buzzer 303. The buzzers 303 are disposed in the first socket body 2. Various buzzers 303 could be disposed by request, such as sense buzzers. When a connecting component capable of being connected to the conducting device 1 approaches, the sense buzzer sounds an "ok" sound, and when a connecting component incapable of being connected to the conducting device 1 approaches, the sense buzzer sounds an alert sound. It could notice a user that the connecting part provides at least two connecting components having different functions for being identified to be selectively engaged so that the engagement could be more convenient and exacter. It is no more described here.

Figure 15:
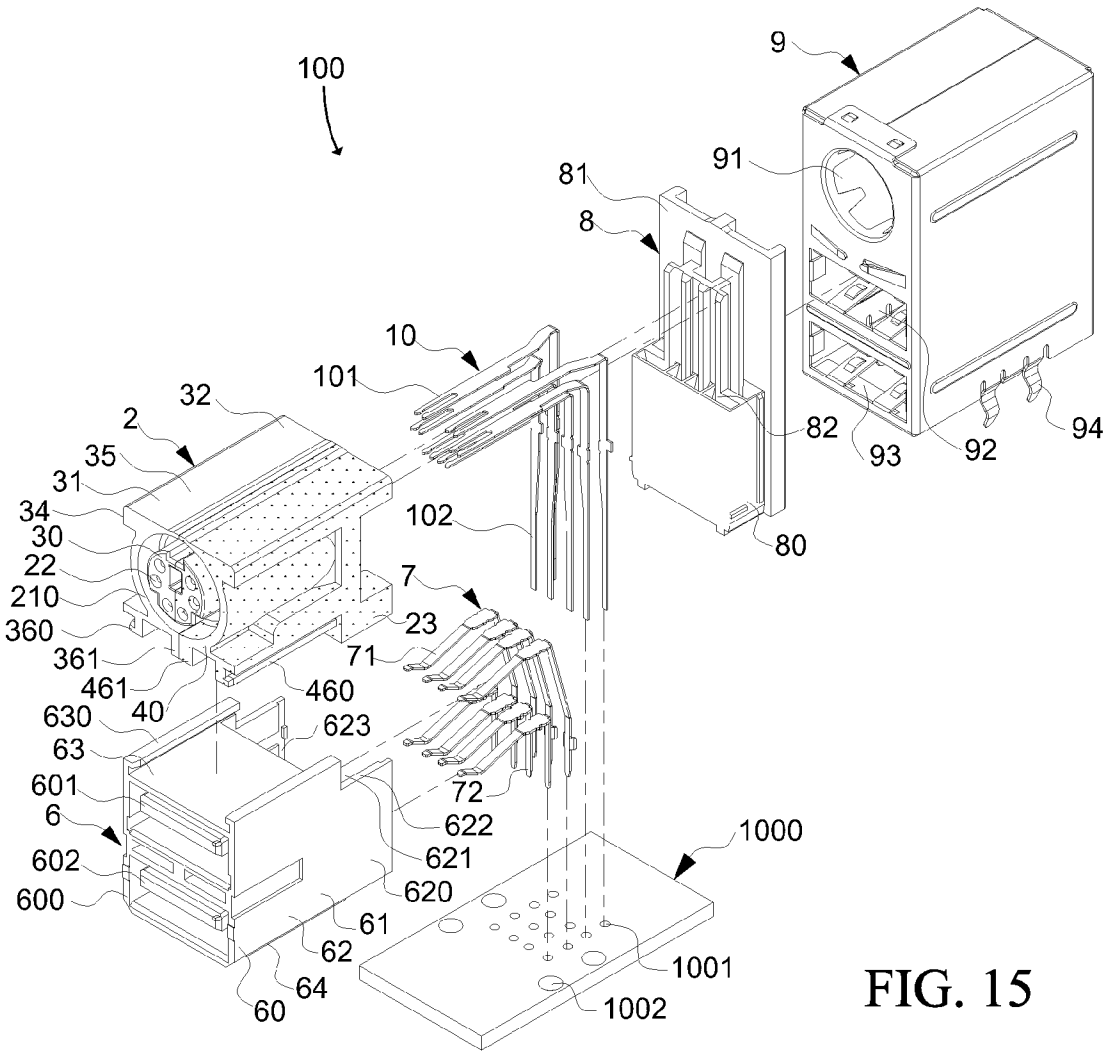
FIG. 15 is an exploded perspective view of a conducting device module combining a conducting device with identification function and a conducting device without identification function.
Figure 16:
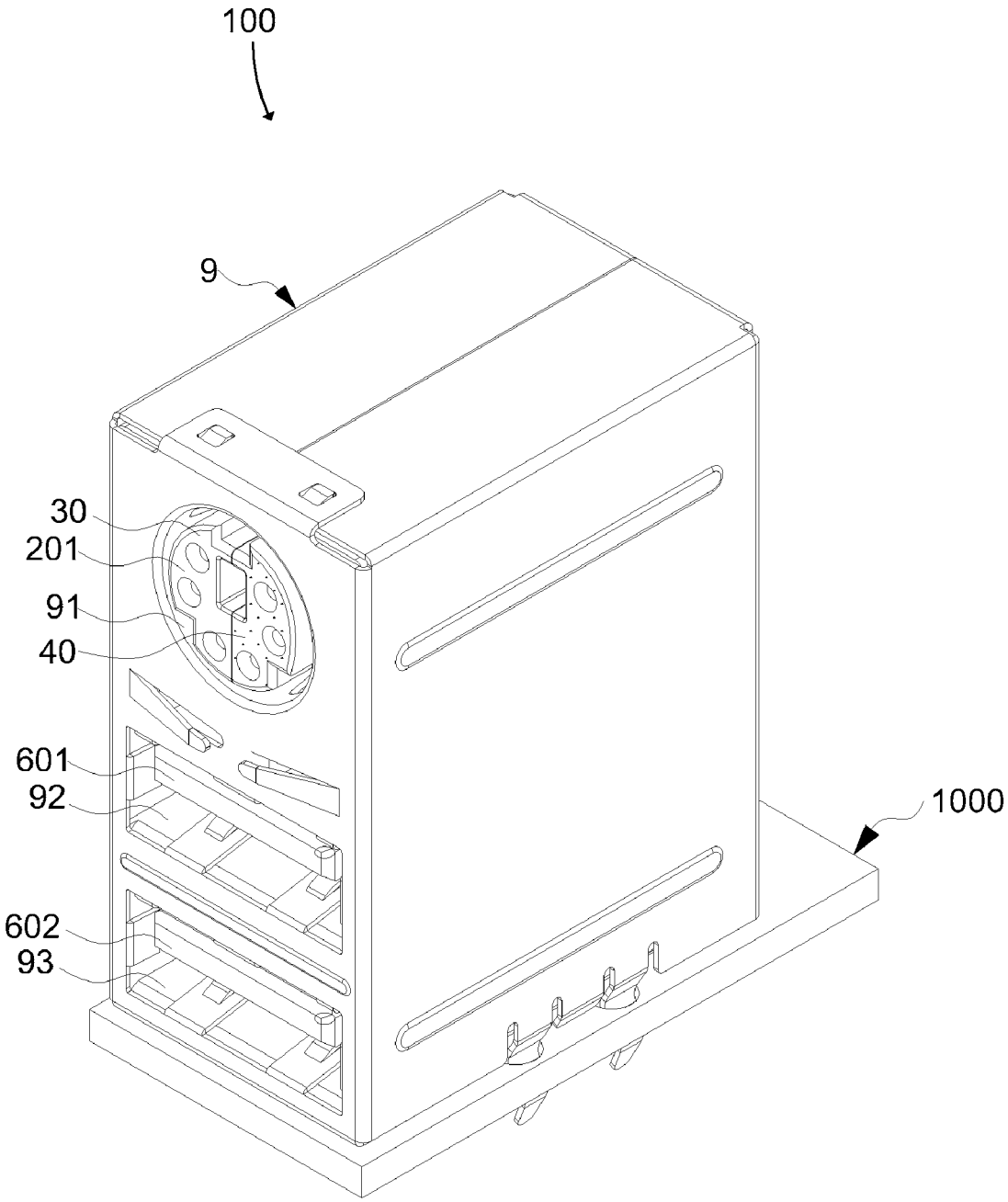
FIG. 16 is an assembly perspective view of the conducting device module in FIG. 15.

Please refer to FIG. 15 and FIG. 16. It is the seventh embodiment according to the invention. The conducting device 1 having identification function of the invention could also be integrated with other conducting devices into a conducting device module 100 having identification function for connecting at least one connecting electrical components (not shown) to a circuit board 1000.

Figure 17:
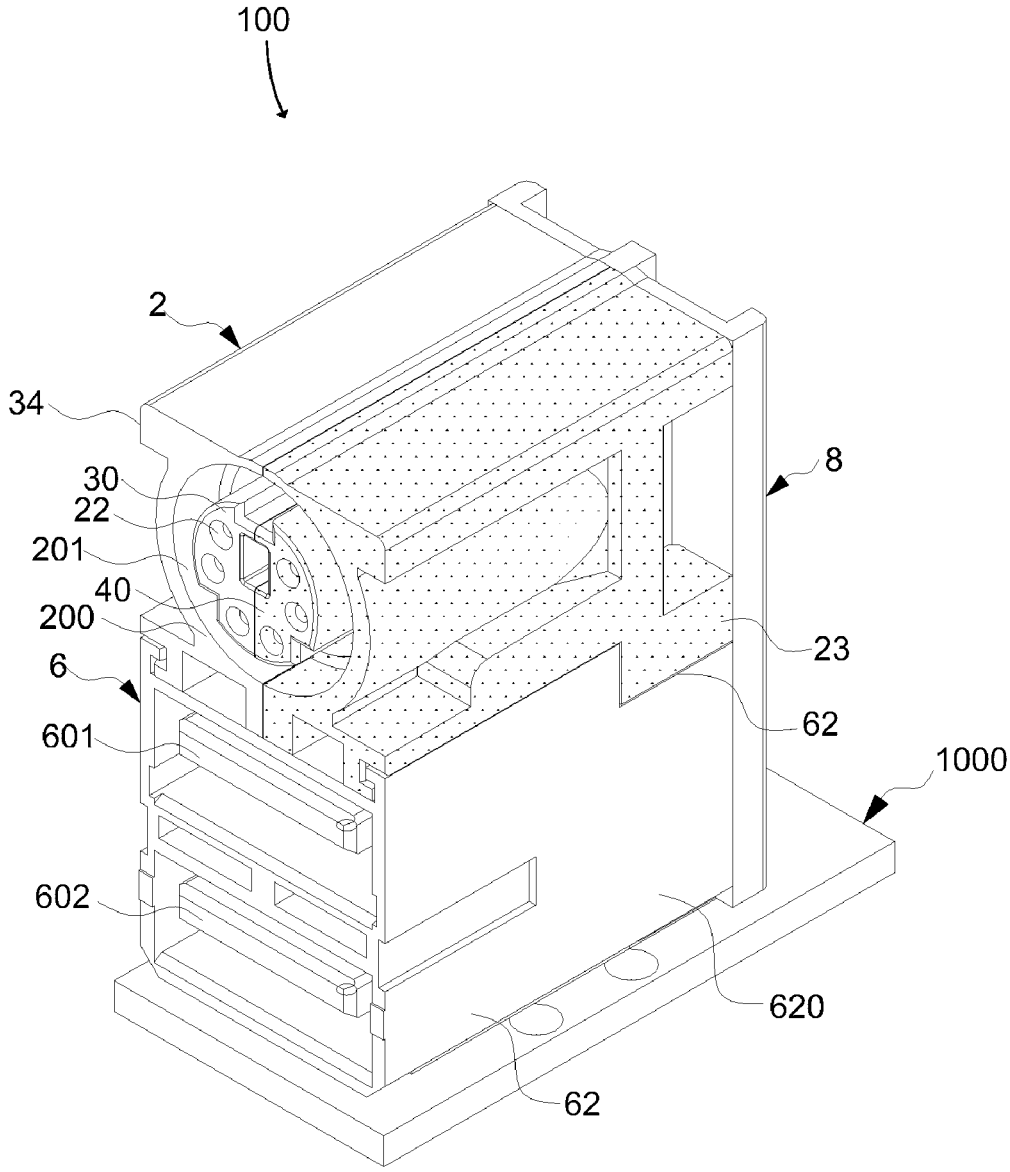
FIG. 17 is a perspective view of the conducting device module in FIG. 16 removing the shielding case.
Figure 18:
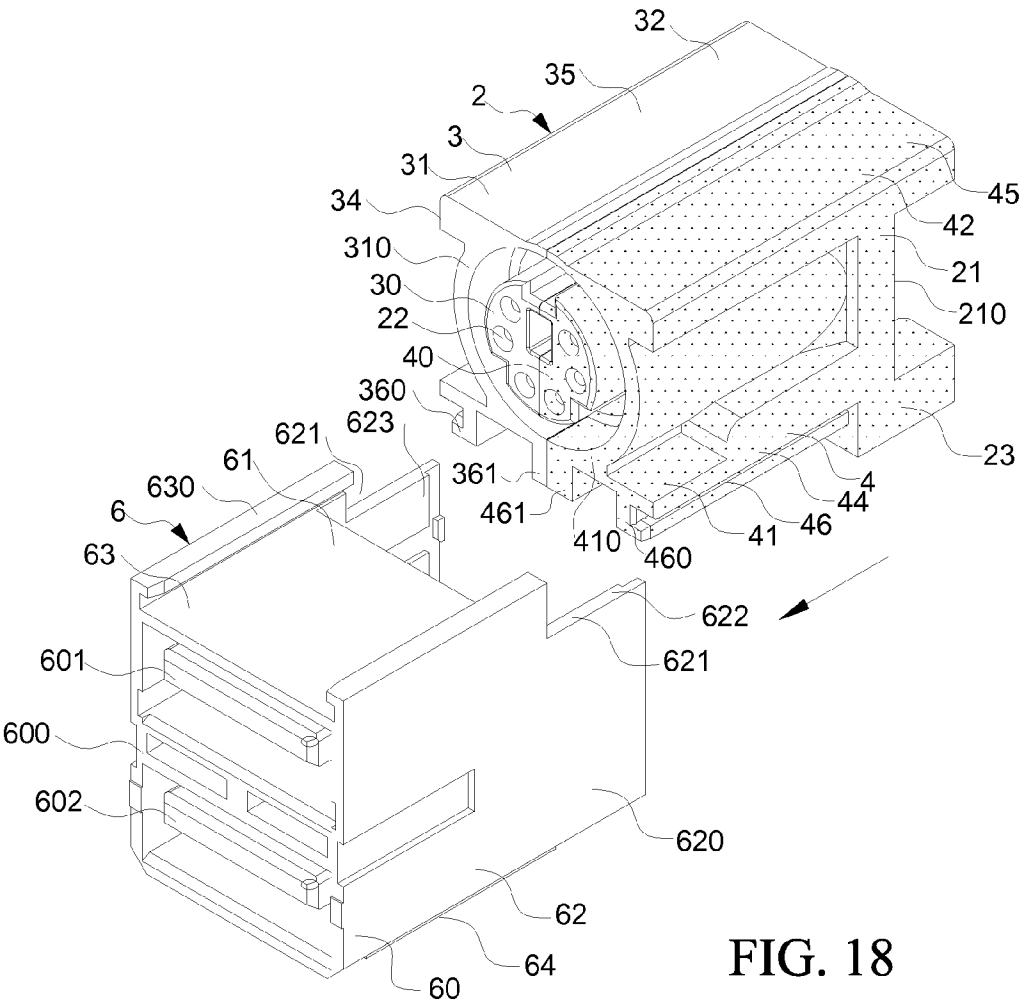
FIG. 18 is an assembly perspective view of the first socket body and the second socket body of the conducting device module in FIG. 17.

Please refer to FIGS. 15, 17 and 18. The conducting device module 100 includes the conducting device 1 having identification function and a conducting device without identification function. A joint base 23 extends at the assembly portion 21 downwards from bottom surfaces 36, 46 of the first semi-body 3 and the second semi-body 4 of the first socket body 2 of the conducting device 1 having identification function. First clasp parts 360, 460 extends downwards from the bottom surfaces 36, 46 of the first semi-body 3 and the second semi-body 4 of the first socket body 2. The first clasp parts 360, 460 extend horizontally from the socket part 20 towards the assembly portion 21 to the front portion of the joint base 23. Holding parts 361, 461 extend downwards from the bottom surfaces 36, 46 of the first semi-body 3 and the second semi-body 4 of the first socket body 2. The holding parts 361, 461 extend horizontally from the socket part 20 towards the assembly portion 21 to the front portion of the joint base 23. A plurality of first conducting terminals 10 are correspondingly inserted in the first terminal-accommodating holes 22. The first conducting terminal 10 has a first connecting part 101 at one end and a first rear portion 102 at another end.

Please refer to FIG. 15. The conducting device without identification function includes a second socket body 6 and a plurality of second conducting terminals 7 accommodated in the second socket body 6.

Please refer to FIGS. 15, 17 and 18. The second body 6 also includes a third connecting part 60 and a third assembly portion 61 away from the third connecting part 60. The third connecting part 60 forms a third connecting surface 600. The third connecting surface 600 forms a second connecting port 60 land a third connecting port 602 which are overlapping up and down. The second socket body 6 includes two third side surface 62, a third top surface 63, and a bottom surface 64 vertical to the third connecting surface 600. A second clasp part 630 is formed and extends upwards from two sides of the third top surface 63 respectively. The second clasp parts 630 extend horizontally between the third connecting part 60 and the third assembly portion 61. The third assembly portion 61 forms a stop wall 620 respectively under the two third side walls 62 extending backwards. The stop walls 620 respectively form a breach 621 above the side walls 62. The top surface of the stop wall 620 forms an engagement surface 622 at the breach 621. The two stop walls 620 and the assembly portion 61 together form an accommodating space 623.

Please refer to FIG. 15. The second conducting terminal 7 has a second connecting part 71 at one end and a second rear portion 72 at another end.

Please refer to FIGS. 15 and 17. The conducting device module 100 further includes a back socket body 8. The back socket body 8 includes a main body 80 and a plate member 81 connected to the main body 80. The main body 80 forms a plurality of terminal-holding holes 82.

Please refer to FIGS. 15 and 16. A shielding casing 9 covers the outer surface of the conducting device module 100. The shielding casing 9 has openings 91, 92, 93 corresponding to the three socket part 20, 601, 602. A plurality of holding pins 94 are disposed on a portion of the shielding casing 9 to contact the circuit board 1000. The shielding casing 9 could protect the conducting device module 100 efficiently and could be grounded for electromagnetic shielding.

Please refer to FIGS. 15 and 16. The circuit board 1000 forms a plurality of holes 1001 thereon for both the first conducting terminals 10 and the second conducting terminals 7 and a plurality of holding holes 1002 for inserting the holding pins 94.

Please refer to FIG. 15. In the assembly, firstly, the plurality of second conducting terminals 7 are disposed correspondingly in second terminal-accommodating holes of the second socket body 6. Then, the first semi-body 3 and the second semi-body 4 forms the first socket body 2 (referring to FIG.

8). The assembled first socket body 2 is disposed on the second socket body 6 with the second conducting terminals thereon. Therefore, the first clasp parts 360, 460 are engaged corresponding to the second clasp parts 630. The holding parts 361, 461 hold the top surface of the second socket body 6. The joint base 23 is engaged to the breach 621, and the bottom surface of the joint base 23 contacts the engagement surface 622. Then, a plurality of the first conducting terminals 10 are disposed correspondingly in the first terminal-accommodating holes 22 of the first socket body 2. And then, the rear portion 102 of the first conducting terminal 10 is aimed at the terminal-holding hole 82 of the back socket body 8, so as to push the back socket body 8 along the connecting part 101 of the first conducting terminal until the top of the back socket body 8 is aligned with the top of the first socket body 2 and the main body 80 is accommodated in the accommodating space 623. At last, the shielding casing 9 is disposed to cover the surface of the conducting device module 100, and the openings 91, 92, 93 are correspondingly aimed at the socket parts 20, 601, 602.

For the conducting device 1 having identification function of the invention according to the eighth embodiment, the first socket body 2 is formed with the first semi-body 3 and the second semi-body 4 and the first semi-body 3 and the second semi-body 4 are formed by injecting plastics with different colors (such as purple and green), so the first semi-body 3 is the first identification unit 30, the first identification unit 30 is a color identification unit, the color of the first identification unit 30 is the same as the color of the first semi-body 3, the second semi-body 4 is the second identification unit 40, the second identification unit 40 is also a color identification unit, the color of the second identification unit 40 is the same as the color of the second semi-body 4. That is, the color of the first identification unit 30 corresponding to a keyboard is purple, and the color of the second identification unit 40 corresponding to a mouse is green. It notices a user that the conducting device 1 having identification function could be used for connecting the keyboard and also for connecting the mouse. Certainly, the first semi-body 3 could be formed by injecting to be a green socket body, and the second semi-body 4 could be formed by injecting to be a purple socket body; that is, the color of the first identification unit 30 corresponding to the mouse is green, and the color of the second identification unit 40 corresponding to the keyboard is purple. It could also achieve the effect that the conducting device 1 having identification function could be used for connecting the keyboard and also for connecting the mouse; that is, it could achieve the effect according to the first embodiment. It is no more described here.

Figure 19:
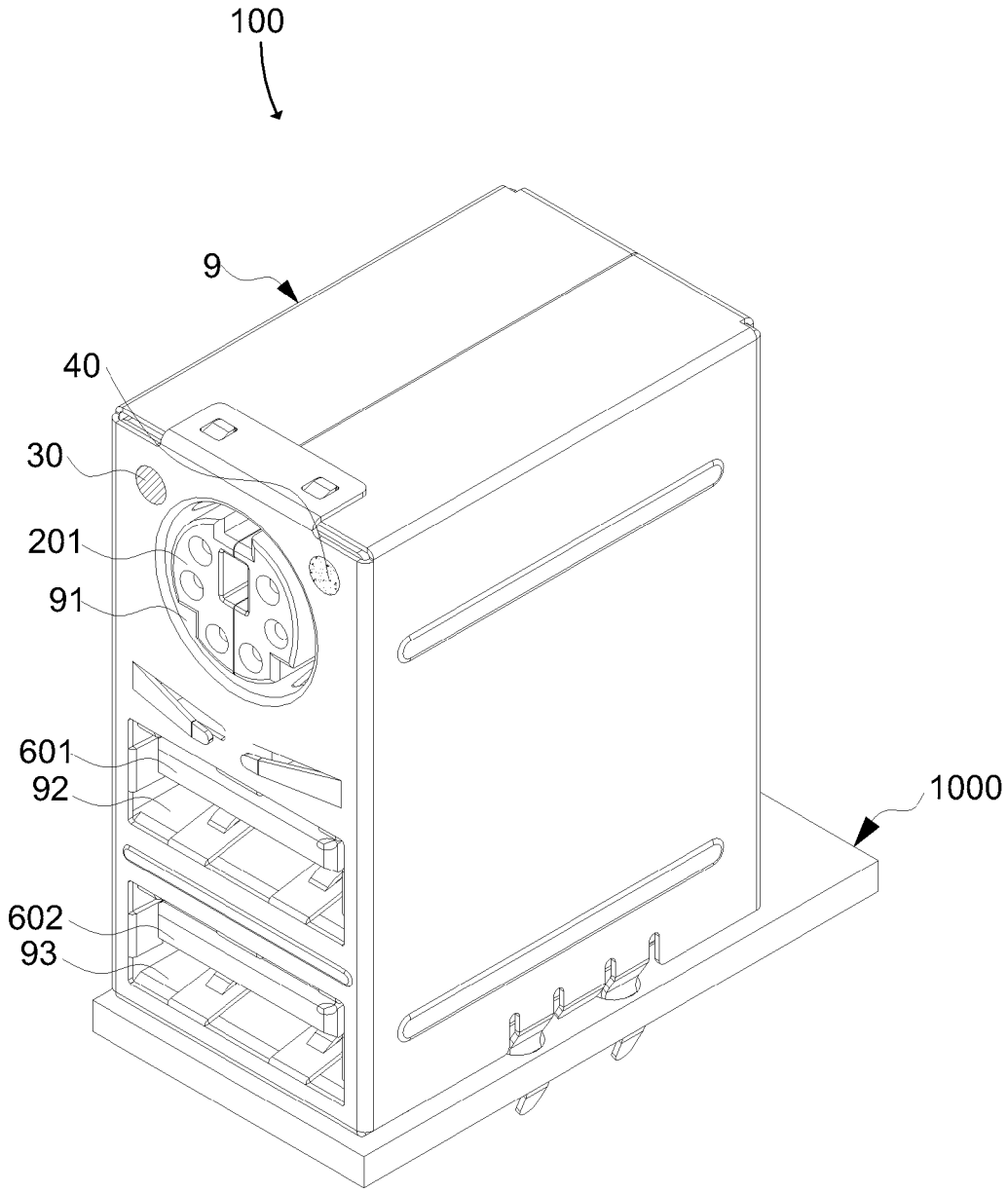
FIG. 19 is a perspective view of a conducting device having identification function of the invention according to the ninth embodiment.

Please refer to FIG. 19. It is the ninth embodiment according to the invention. What is different to the eighth embodiment is that: for the conducting device module 100 having identification function, the first identification unit 30 is a colored paster pasted on the shielding casing 9, and the surface of the colored paster has a colored area, such as a purple area; of course, the colored area could form a keyboard pattern. And the second identification unit 40 is another colored paster pasted on the shielding casing 9, and the surface of the another colored paster has another colored area, such as a green area; of course, the another colored area could form a mouse pattern. Of course, the first identification unit 30 could also form a colored area, such as a purple area, by painting a color paint on the shielding casing; of course, the colored area could form a keyboard pattern. The second identification unit 40 could also form another colored area, such as a green area, by painting another color paint on the shielding casing; of course, the another colored area could form a mouse pattern. It also notices a user that the connecting part provides at least two connecting components having different functions for being identified to be selectively engaged so that the engagement could be more convenient and exacter. It is no more described here.

Figure 20:
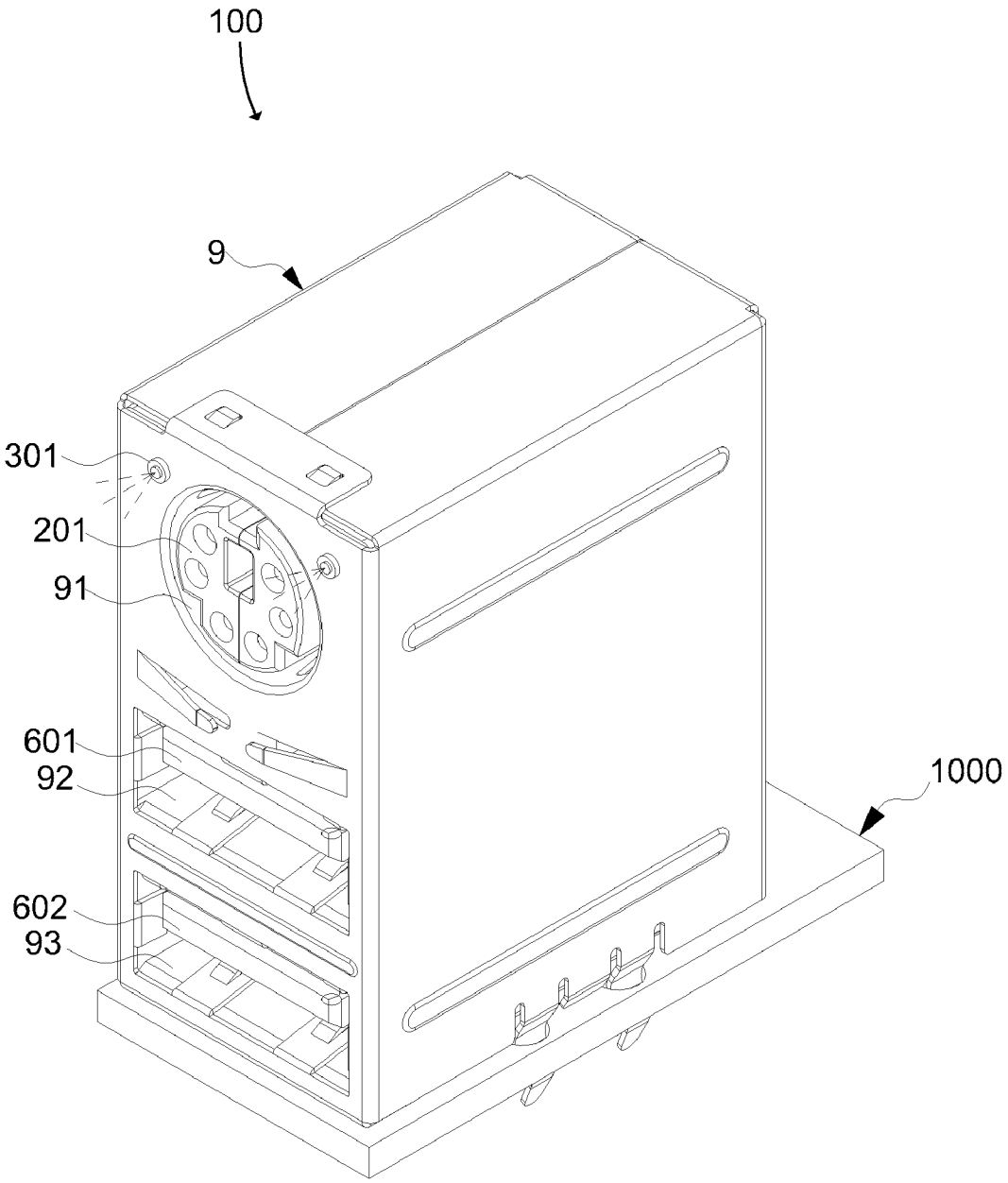
FIG. 20 is a perspective view of a conducting device having identification function of the invention according to the tenth embodiment.

Please refer to FIG. 20. It is the tenth embodiment according to the invention. What is different to the eighth embodiment is that: for the conducting device module 100 having identification function, the first identification unit 30 and the second identification unit 40 respectively have at least one light 301 emitting light in different colors and disposed in the conducting device module 100 or protruding out of the surface of the shielding casing 9. The lights respectively are a LED lamp.

Figure 21:
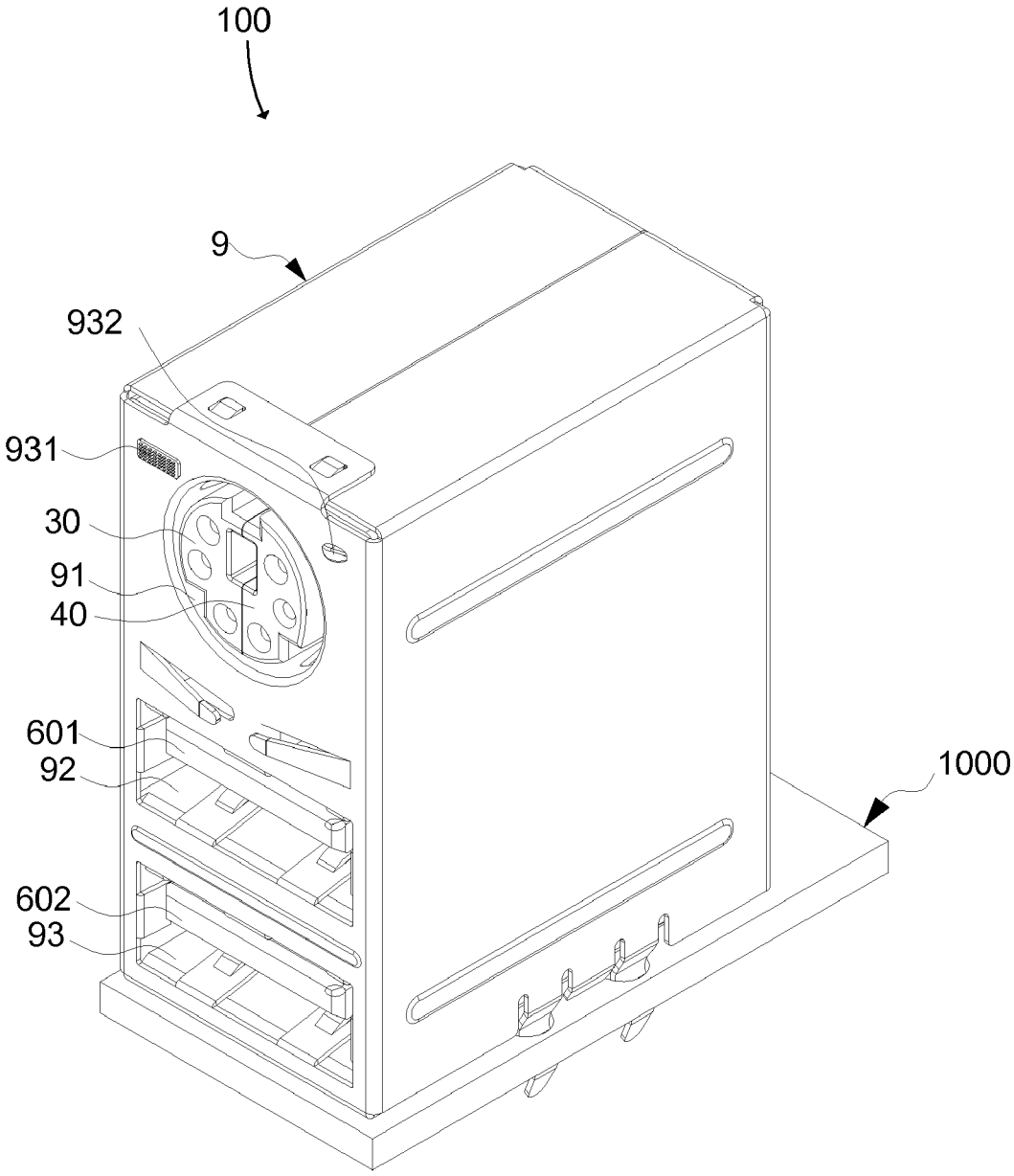
FIG. 21 is a perspective view of a conducting device having identification function of the invention according to the eleventh embodiment.

Please refer to FIG. 21. It is the eleventh embodiment according to the invention. What is different to the eighth embodiment is that: for the conducting device module 100 having identification function, the first identification unit 30 has a contact part 931 at least on the surface of the shielding casing 9, the second identification unit 40 has a contact part 932 at least on the surface of the shielding casing 9, the two contact parts 931, 932 have different modeling to each other, that is, the contact part 931, 932 could be a groove, a protrusive block, or a pictorial pattern. In this embodiment, the first identification unit 30 is a keyboard perspective pattern, and the second identification unit 40 is a mouse perspective pattern. Of course, the first identification unit 30 could have a plurality of the contact parts 931 on the surface of the shielding casing 9 to be arranged into a Braille pattern, and the second identification unit 40 could have a plurality of the contact parts 932 on the surface of the shielding casing 9 to be arranged into another Braille pattern (not shown). Therefore, it offers a user to get identification information by contacting and makes the engagement more convenient and exacter. It is no more described here.

Figure 22:
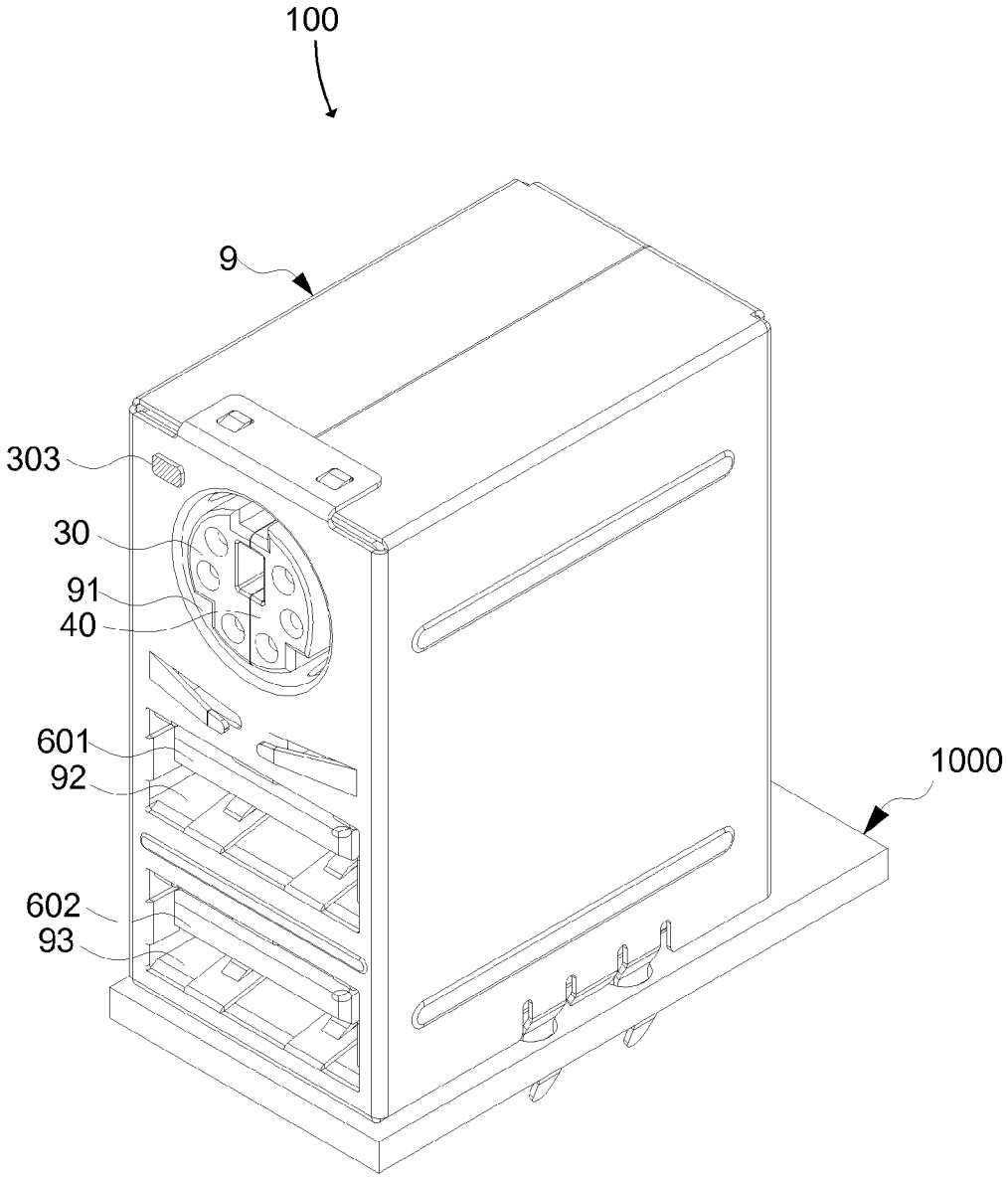
FIG. 22 is a perspective view of a conducting device having identification function of the invention according to the twelfth embodiment.

Please refer to FIG. 22. It is the twelfth embodiment according to the invention. What is different to the eighth embodiment is that: for the conducting device module 100 having identification function, the first identification unit 30 and the second identification unit 40 respectively have at least one buzzer 303. The buzzers 303 could be disposed anywhere of the conducting device module 100. Various buzzers 303 could be disposed by request.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A socket device having identification functions, comprising:

a device body (2) comprising an engaging portion for receiving a single connector, the device body (2) comprising a first semi-body (3), and a second semi-body (4) engaged with the first semi-body (3); and a plurality of contacting terminals (10), for correspondingly contacting with terminals of the single connector, divided into a first and a second identical groups;

wherein the first semi-body (3) has a plurality of terminal-accommodating holes for receiving the first group of the contacting terminals (10);

wherein the second semi-body (4) has a plurality of terminal-accommodating holes for receiving the second group of the contacting terminals;

wherein the first semi-body has a first identification unit, and wherein the second semi-body has a second identification unit.

2. The socket device having identification function of claim 1, wherein the first identification unit and the second identification unit are identification units having different colors.

3. The socket device having identification function of claim 2, wherein the first identification unit and the second identification unit are colored areas on the surface of the engaging portion having different colors, wherein the engaging portion is substantially circle-shaped, and each semi-body has a connecting surface at a front end thereof, the connecting surface is substantially semicircle-shaped.

4. The socket device having identification function of claim 3, wherein the colored areas have many kinds of color combinations, and the color combinations are different.

5. The socket device having identification function of claim 3, wherein the colored areas are monochromatic respectively and different.

6. The socket device having identification function of claim 3, wherein the first identification unit is a colored paster pasted on the device body, one of the colored areas is defined on a surface of said colored paster, the second identification unit is a colored paster pasted on the device body, and one of the colored areas is defined on a surface of said colored paster.

7. The socket device having identification function of claim 3, wherein the first identification unit is formed by painting a color paint on the device body, one of the colored areas is defined on a surface of said color paint, the second identification unit is formed by painting another color paint on the device body, and one of the colored areas is defined on a surface of said color paint.

8. The socket device having identification function of claim 3, wherein the color of the colored area of the first identification unit and the color of the device body are the same.

9. The socket device having identification function of claim 3, wherein the color of the colored area of the second identification unit and the color of the device body are the same.

10. The socket device having identification function of claim 3, wherein the colored area forms a pattern.

11. The socket device having identification function of claim 1, wherein the first identification unit and the second identification unit respectively comprise at least one light emitting light in different colors.

12. The socket device having identification function of claim 11, wherein the lights respectively are a LED lamp.

13. The socket device having identification function of claim 1, wherein the first identification unit and the second identification unit respectively comprise a contact part on a surface of the device body, and said two contact parts have different modeling to each other, so as to offer a user to get identification information by contacting.

14. The socket device having identification function of claim 13, wherein the contact part is a groove.

15. The socket device having identification function of claim 13, wherein the contact part is a protrusive block.

16. The socket device having identification function of claim 13, wherein the first identification unit comprises a plurality of the contact parts on the surface of the device body arranged into a Braille pattern, and the second identification unit comprises a plurality of the contact parts on the surface of the device body arranged into another Braille pattern.

17. The socket device having identification function of claim 1, wherein the first identification unit and the second identification unit respectively comprise at least one buzzer.

18. The socket device having identification function of claim 17, wherein the buzzer is disposed in the device body.

19. A socket member in a socket device having identification function, comprising:

a device body for receiving a single connector, the device body (2) comprising a first semi-body (3), and a second semi-body (4) engaged with the first semi-body (3); and a plurality of contacting terminals (10), for correspondingly contacting with terminals of the single connector, divided into a first and a second identical groups, wherein the first group of contacting terminals is received in the first semi-body (3), and the second group of contacting terminals is received in the second semi-body (4); wherein the first semi-body (3) has a first engaging end, the second semi-body (4) has a second engaging end coupled with the first engaging end, the first engaging end comprises a first identification unit, and the second engaging end comprises a second identification unit.

20. The socket member in a socket device having identification function of claim 19, wherein the first identification unit and the second identification unit are identification units having different colors.

21. The socket member in a socket device having identification function of claim 20, wherein the first identification unit and the second identification unit are colored area on the surface of the first and the second engaging ends respectively having different colors.

22. The socket member in a socket device having identification function of claim 21, wherein the colored areas have many kinds of color combinations, and the color combinations are different.

23. The socket member in a socket device having identification function of claim 21, wherein the colored areas are monochromatic respectively and different.

24. The socket member in a socket device having identification function of claim 21, wherein the first identification unit is a colored paster pasted on the first engaging end, one of the colored areas is defined on a surface of said colored paster, the second identification unit is a colored paster pasted on the second engaging end, and one of the colored areas is defined on a surface of said colored paster.

25. The socket member in a socket device having identification function of claim 21, wherein the first identification unit is formed by painting a color paint on the first engaging end, one of the colored areas is defined on a surface of said color paint, the second identification unit is formed by painting another color paint on the second engaging end, and one of the colored areas is defined on a surface of said color paint.

26. The socket member in a socket device having identification function of claim 21, wherein the color of the colored area of the first identification unit and the color of the first engaging end are the same.

27. The socket member in a socket device having identification function of claim 21, wherein the color of the colored area of the second identification unit and the color of the second engaging end are the same.

28. The socket member in a socket device having identification function of claim 21, wherein the colored area forms a pattern.

29. The socket member in a socket device having identification function of claim 19, wherein the first identification unit and the second identification unit respectively comprise at least one light emitting light in different colors.

30. The socket member in a socket device having identification function of claim 29, wherein the lights respectively are a LED lamp.

31. The socket member in a socket device having identification function of claim 19, wherein the first identification unit comprises a contact part on a surface of the first engaging end, the second identification unit comprises a contact part on a surface of the second engaging end, and said two contact parts have different modeling to each other, so as to offer a user to get identification information by contacting.

32. The socket member in a socket device having identification function of claim 31, wherein the contact part is a groove.

33. The socket member in a socket device having identification function of claim 31, wherein the contact part is a protrusive block.

34. The socket member in a socket device having identification function of claim 31, wherein the first identification unit comprises a plurality of the contact parts on the surface of the first engaging end arranged into a Braille pattern, and the second identification unit comprises a plurality of the contact parts on the surface of the second engaging end arranged into another Braille pattern.

35. The socket member in a socket device having identification function of claim 19, wherein the first identification unit and the second identification unit respectively comprise at least one buzzer.

36. The socket member in a socket device having identification function of claim 35, wherein the buzzer is disposed in the socket body.

37. The socket member in a socket device having identification function of claim 19, wherein at least one clasp part is protrusively formed on an inner side surface of the first engaging end, at least one clasp groove is depressedly formed on an inner side surface of the second engaging end, and the clasp part is engaged correspondingly to the clasp groove.

38. The socket member in a socket device having identification function of claim 1, further comprising a second body is disposed under the device body, the second body forms a stop wall extending backwards from two side walls thereof respectively, the stop walls respectively form a breach above the side walls, a top surface of the stop wall forms an engagement surface at the breach;

wherein the device body is formed with a joint base extending downwards from a bottom surface of a rear portion thereof, the joint base is engaged to the breach, and a bottom surface of the joint base contacts the engagement surface.

39. The socket member in a socket device having identification function of claim 1, further comprising a second body is disposed under the device body, the second body forms a second clasp part extending upwards from two sides of a top surface thereof respectively, wherein the first engaging end and the second engaging end of the device body respectively form a first clasp part extending downwards from a bottom surface thereof, and the first clasp part is engaged to the second clasp part.

40. A socket device having identification functions, comprising:

a device body comprising an engaging portion for receiving a single connector, the device body comprising a first semi-body, and a second semi-body engaged with the first semi-body;

a plurality of contacting terminals (10), for correspondingly contacting with terminals of the single connector, divided into a first and a second identical groups;

wherein the first semi-body (3) has a plurality of terminal-accommodating holes for receiving the first group of the contacting terminals (10);

wherein the second semi-body (4) has a plurality of terminal-accommodating holes for receiving the second group of the contacting terminals; and a shielding casing for receiving the device body therein, wherein the shielding casing has an opening corresponding to the engaging portion;

wherein the shielding casing comprises a first identification unit, and a second identification unit, the first and second identifications are located adjacent to the opening.

41. The socket device having identification function of claim 40, wherein the first identification unit and the second identification unit are identification units having different colors.

42. The socket device having identification function of claim 41, wherein the first identification unit and the second identification unit are colored area on the surface of the first and the second semi-bodies respectively having different colors.

43. The socket device having identification function of claim 42, wherein the colored areas have many kinds of color combinations, and the color combinations are different.

44. The socket device having identification function of claim 42, wherein the colored areas are monochromatic respectively and different.

45. The socket device having identification function of claim 42, wherein the first identification unit is a colored paster pasted on the first semi-body, one of the colored areas is defined on a surface of said colored paster, the second identification unit is a colored paster pasted on the second semi-body, and one of the colored areas is defined on a surface of said colored paster.

46. The socket device having identification function of claim 42, wherein the first identification unit is formed by painting a color paint on the first semi-body, a surface of the first color paint is the first colored area, one of the colored areas is defined on a surface of said color paint, the second identification unit is formed by painting another color paint on the second semi-body, and one of the colored areas is defined on a surface of said color paint.

47. The socket device having identification function of claim 42, wherein a cap with at least two different colored blocks on a surface thereof is on a front portion of the connecting part, one of the colored blocks is the first identification unit, and another of the colored blocks is the second identification unit.

48. The socket device having identification function of claim 42, wherein the color of the colored area of the first identification unit and the color of the first semi-body are the same.

49. The socket device having identification function of claim 42, wherein the color of the colored area of the second identification unit and the color of the second semi-body are the same.

50. The socket device having identification function of claim 42, wherein the colored area forms a pattern.

51. The socket device having identification function of claim 40, wherein the first identification unit and the second identification unit respectively comprise at least one light emitting light in different colors.

52. The socket device having identification function of claim 51, wherein the lights respectively are a LED lamp.

53. The socket device having identification function of claim 40, wherein the first identification unit comprises a contact part on a surface of the first semi-body, the second identification unit comprises a contact part on a surface of the second semi-body, and said two contact parts have different modeling to each other, so as to offer a user to get identification information by contacting.

54. The socket device having identification function of claim 53, wherein the contact part is a groove.

55. The socket device having identification function of claim 53, wherein the contact part is a protrusive block.

56. The socket device having identification function of claim 53, wherein the first identification unit comprises a plurality of the contact parts on the surface of the first semi-body arranged into a Braille pattern, and the second identification unit comprises a plurality of the contact parts on the surface of the second semi-body arranged into another Braille pattern.

57. The socket device having identification function of claim 40, wherein the first identification unit and the second identification unit respectively comprise at least one buzzer.

58. The socket device having identification function of claim 40, wherein the buzzer is disposed in the device body.

* * * * *